US010780568B2

(12) United States Patent
Gusack

(10) Patent No.: US 10,780,568 B2
(45) Date of Patent: Sep. 22, 2020

(54) CONFIGURABLE TOOL SET FOR MANIPULATING OBJECTS

(71) Applicant: Mark David Gusack, Huntington, WV (US)

(72) Inventor: Mark David Gusack, Huntington, WV (US)

( * ) Notice: Subject to any disclaimer, the term of this patent is extended or adjusted under 35 U.S.C. 154(b) by 162 days.

(21) Appl. No.: 15/932,707

(22) Filed: Apr. 9, 2018

(65) Prior Publication Data

US 2019/0308310 A1 Oct. 10, 2019

Related U.S. Application Data

(60) Provisional application No. 62/602,079, filed on Apr. 10, 2017.

(51) Int. Cl.
*B25G 1/04* (2006.01)
*B25G 1/06* (2006.01)
*B25G 1/10* (2006.01)

(52) U.S. Cl.
CPC ..... *B25G 1/04* (2013.01); *B25G 1/06* (2013.01); *B25G 1/10* (2013.01); *B25G 1/107* (2013.01)

(58) Field of Classification Search
CPC ..... B25G 1/06; B25G 1/107
USPC ..... 81/489, 177.1, 177.2
See application file for complete search history.

(56) References Cited

U.S. PATENT DOCUMENTS 147,930 A 2/1874 Galland
274,695 A 3/1883 Badger
277,531 A 5/1883 Ackermann
365,810 A 7/1887 Harris
372,903 A 11/1887 Forster
448,155 A 3/1891 Merrill
503,011 A 8/1893 Stathem
565,374 A 8/1896 Yarbrough
684,685 A * 10/1901 Gerst ..... A47L 13/19 401/7
967,410 A 8/1910 Montgomery
984,179 A 2/1911 Aydt
1,652,072 A 12/1927 Vanek
1,902,453 A 3/1933 Kaiser
1,997,851 A 4/1935 Botts ..... 30/24
2,024,849 A 12/1935 Eliopoulos ..... 294/99
2,151,846 A 3/1939 Greneker ..... 81/1
2,177,205 A 10/1939 Dalmas ..... 132/73.5
2,285,885 A 6/1942 Becker ..... 3/12
2,333,009 A 10/1943 Hosmer ..... 3/12
2,418,638 A 4/1947 Hoover ..... 81/121
2,482,350 A * 9/1949 Leniz ..... B25B 15/02 81/177.3
2,509,837 A 5/1950 Niizawa ..... 120/42.4
2,526,105 A 10/1950 Adams ..... 64/7
2,549,074 A 4/1951 Fishbein ..... 3/12
2,556,524 A 6/1951 Drennon ..... 3/12
2,561,523 A 7/1951 Lux ..... 32/12
2,585,641 A 2/1952 Faso ..... 81/177
2,685,880 A 8/1954 Curutchet ..... 128/321
2,706,296 A 4/1955 Fletcher ..... 3/12.7
2,711,339 A 6/1955 Mcgogy ..... 294/99
2,728,932 A 1/1956 Ramsey, Sr. ..... 15/227
(Continued)

*Primary Examiner* — Hadi Shakeri

(57) ABSTRACT

The present invention defines a unique structure and methodology for creating a plurality of configurable and extensible tools that can be affixed to a plurality of digits and equipment to form tool sets for working more easily with objects.

15 Claims, 5 Drawing Sheets

(56) References Cited

U.S. PATENT DOCUMENTS

| | | | | | |
|---|---|---|---|---|---|
| 2,735,321 | A | | 2/1956 | Brown | 81/13 |
| 2,788,817 | A | | 4/1957 | Leniz | 145/50 |
| 2,846,766 | A | | 8/1958 | Harter | 30/341 |
| 2,867,819 | A | | 1/1959 | George | 3/12.6 |
| 2,889,160 | A | | 6/1959 | Nelson | 287/14 |
| 2,989,807 | A | | 6/1961 | Florence | 30/151 |
| 3,002,409 | A | * | 10/1961 | Jones | B25G 1/025 81/177.2 |
| 3,075,498 | A | | 1/1963 | Udcoff | 120/102 |
| 3,186,749 | A | | 6/1965 | Dawes | 294/16 |
| 3,239,262 | A | | 3/1966 | Rines | 294/16 |
| 3,293,958 | A | * | 12/1966 | Smith | A61B 17/30 294/25 |
| 3,304,111 | A | | 2/1967 | Kauh | 294/16 |
| 3,323,825 | A | | 6/1967 | Arima | 294/16 |
| 3,392,727 | A | | 7/1968 | Hanlon | 128/321 |
| 3,399,456 | A | | 9/1968 | Johnson | 30/232 |
| 3,490,078 | A | | 1/1970 | Perez, Jr. | 3/12.8 |
| 3,501,191 | A | | 3/1970 | Darr | 294/16 |
| 3,505,700 | A | | 4/1970 | Rodriguez | 15/160 |
| 3,553,819 | A | | 1/1971 | Johnson | 29/407 |
| 3,637,248 | A | | 1/1972 | Arita | 294/16 |
| 3,640,561 | A | | 2/1972 | Law | 294/99 X |
| 3,802,302 | A | | 4/1974 | Bengtson | 81/177 |
| 3,834,024 | A | | 9/1974 | White | 30/232 |
| 3,887,286 | A | | 6/1975 | Bucey | 401/7 |
| 3,889,995 | A | | 6/1975 | Lin | 294/99 R |
| 3,892,435 | A | | 7/1975 | Huey | 294/16 |
| 3,937,510 | A | | 2/1976 | Lew | 294/16 |
| 3,942,194 | A | | 3/1976 | Winter | 3/1 |
| D242,760 | S | | 12/1976 | Jensen | D7/149 |
| 4,089,379 | A | | 5/1978 | Crownover | 172/270 |
| 4,093,297 | A | | 6/1978 | Reiber | 294/99 R |
| 4,127,338 | A | | 11/1978 | Laybourne | 401/8 |
| 4,130,912 | A | * | 12/1978 | Sheppard | G11B 5/41 15/144.4 |
| 4,199,180 | A | | 4/1980 | Kelly | 294/33 |
| 4,223,936 | A | | 9/1980 | Jorgensen | 294/16 |
| 4,261,608 | A | | 4/1981 | Bradshaw | 294/25 |
| 4,291,421 | A | | 9/1981 | Massey | 3/12.6 |
| 4,325,187 | A | | 4/1982 | Wasson | 30/327 |
| 4,332,178 | A | | 6/1982 | Vukich | 81/439 |
| 4,543,032 | A | | 9/1985 | Leverett | 414/730 |
| 4,576,408 | A | | 3/1986 | Maneki | 294/99.2 |
| 4,606,484 | A | | 8/1986 | Winter | 224/218 |
| 4,627,785 | A | | 12/1986 | Monforte | 414/730 |
| 4,659,128 | A | | 4/1987 | Dong | 294/99.2 |
| 4,661,113 | A | * | 4/1987 | Adkins | A61F 2/588 473/229 |
| 4,685,924 | A | | 8/1987 | Massey | 623/63 |
| 4,685,929 | A | | 8/1987 | Monestier | 623/64 |
| 4,721,334 | A | | 1/1988 | Nakatsu | 294/99.2 |
| 4,787,663 | A | | 11/1988 | Laramie | 294/99.2 |
| 4,809,435 | A | | 3/1989 | Printz | 30/142 |
| 4,821,417 | A | * | 4/1989 | Levine | A47G 21/08 30/142 |
| 4,944,766 | A | | 7/1990 | Williams | 623/65 |
| D310,465 | S | | 9/1990 | Bonasia | D7/644 |
| 4,973,095 | A | | 11/1990 | Kunishisa | 294/99.2 |
| 5,150,261 | A | * | 9/1992 | Tsai | B25B 15/00 359/810 |
| 5,391,010 | A | | 2/1995 | Gorbunov | 401/8 |
| 5,405,206 | A | | 4/1995 | Bedol | 401/7 |
| 5,458,388 | A | | 10/1995 | Danek | 294/100 |
| 5,486,029 | A | | 1/1996 | Kobayashi | 294/99.2 |
| 5,697,659 | A | | 12/1997 | Calagui | 294/99.2 |
| 5,853,210 | A | | 12/1998 | Robinson | 294/25 |
| 5,885,018 | A | | 2/1999 | Sato | 401/8 |
| 5,894,971 | A | | 4/1999 | Huang | 224/218 |
| 5,925,064 | A | | 7/1999 | Meyers | 606/205 |
| 5,971,642 | A | | 10/1999 | O'Mara | 401/8 |
| 6,009,600 | A | | 1/2000 | Egeland | 16/436 |
| 6,161,974 | A | | 12/2000 | Nakagawa | 401/6 |
| 6,238,358 | B1 | | 5/2001 | Philot | 602/5 |
| 6,332,888 | B1 | | 12/2001 | Levy | 606/144 |
| 6,454,328 | B1 | | 9/2002 | Barillos | 294/16 |
| 6,457,238 | B1 | | 10/2002 | Maier | 30/142 |
| 6,581,997 | B1 | | 6/2003 | Martkainen | 294/99.2 |
| 6,637,962 | B1 | | 10/2003 | Roche | 401/7 |
| 6,834,570 | B2 | | 12/2004 | Risollo | 81/177.3 |
| 6,908,489 | B2 | | 6/2005 | Didrick | 623/64 |
| 7,108,395 | B2 | * | 9/2006 | Correa | A61B 17/30 362/119 |
| 7,182,378 | B2 | | 2/2007 | Inomata | 294/99.2 |
| 7,229,346 | B1 | | 6/2007 | Minker | 451/523 |
| 7,340,984 | B2 | * | 3/2008 | Hsieh | B25B 13/06 81/125.1 |
| 7,461,882 | B2 | | 12/2008 | Choi | 294/100 |
| 7,661,896 | B2 | | 2/2010 | Zawitz | 401/6 |
| 7,878,563 | B2 | | 2/2011 | Beckham | 294/1.1 |
| 8,152,396 | B2 | | 4/2012 | Kuykendall | 401/6 |
| 8,337,568 | B2 | | 12/2012 | Macduff | 623/64 |
| 8,371,190 | B2 | | 2/2013 | Miller | 81/177.3 |
| 8,561,505 | B2 | * | 10/2013 | Richardson | B25B 13/04 81/177.2 |
| 8,733,215 | B1 | * | 5/2014 | Kravitch | B25B 13/48 81/177.2 |
| 8,840,157 | B2 | | 9/2014 | Dempsey | 294/25 |
| 8,919,840 | B2 | | 12/2014 | Savran | 294/99.1 |
| 9,333,084 | B2 | | 5/2016 | Berelsman | 81/345 |
| 9,375,319 | B2 | | 6/2016 | Macduff | 623/63 |
| 9,468,322 | B2 | | 10/2016 | Woo | 294/218 |
| 9,930,995 | B2 | | 4/2018 | Nikolitsis | 294/99.2 |
| 9,931,229 | B2 | | 4/2018 | Veatch | 2/588 |
| 9,931,745 | B2 | | 4/2018 | Freuler | 81/489 |
| 9,931,865 | B2 | | 4/2018 | Shimizu | 29/22 |
| 2009/0165307 | A1 | | 7/2009 | Lam | 30/123 |

* cited by examiner

CONFIGURABLE TOOL SET FOR MANIPULATING OBJECTS

CROSS-REFERENCE TO RELATED APPLICATIONS

This application claims the benefit of provisional patent application Ser. No. 62/602,079, filed 2017 Apr. 10 by the present inventor.

FEDERALLY SPONSORED RESEARCH

Not Applicable

SEQUENCE LISTING OR PROGRAM Not Applicable

BACKGROUND

Field of Invention

This invention relates to a unique structure and methodology creating a configurable and extendible set of tools that can be affixed to fingers, thumbs, prostheses, machines, and robotic devices to provide the means to more easily work with objects.

Description of Prior Art

A wide variety of hand held tools have been invented in the past to spear, grasp, pick up, move, manipulate, modify, and release (herein below referred to as work) things of various types, shapes, consistency, weight, and sizes (herein below referred to as objects). This includes but is not limited to such fields as healthcare, manufacturing, artwork, writing, woodworking, construction, and even eating. For many purposes, using the thumb and a plurality of fingers (herein below referred to as digits) to hold a tool has been adequate. However, small objects, delicate objects, and potentially dangerous objects can be difficult to work with, especially if the object is difficult to reach, fine motor skills are lacking, the fingers are too big, or too short, or, one or more digits have been lost or are otherwise nonfunctional. More recently, the development of automated machines and robotics has created a need for replacing devices (herein below referred to as configurability) and modifying their reach and/or angle (herein below referred to as extensibility) while advances in prosthetics has led to the need for specialized attachments. (Prostheses, machines, and robotic devices are herein below referred to as equipment). The present invention reveals a unique structure and methodology for providing a configurable and extensible tool set that can be affixed to a plurality of digits and equipment to work with objects with greater capability, and functionality.

A Review of Prior Art

Although there are innumerable inventions that allow for reconfiguring and extending utensils and tools, almost all require the user grasp the tool and squeeze, twist, brush, or carry out some other manipulation to work with objects. This often requires the use of muscles enervated for more gross movements and makes fine motor manipulation of the tool difficult. A prior art search produced many inventions that attempt to solve some but not all these problems. For example, U.S. Pat. No. 3,555,819 and its sister, U.S. Pat. No. 3,399,456 reveal a design for finger-held tools. In these two patents, individual tools are described and illustrated that can be mounted on a plurality of fingers but not the thumb. None of the tools is configurable. Furthermore, the first patent states that "the tools are alternately brought against the thumb to perform an associated operation such as cutting, bending, positioning, or gripping". That means only those fingers on the same hand as the thumb can be used while the thumb must be kept free. Furthermore, the means by which a tool is affixed to or removed from a finger involves a complex strap necessitating several steps which is also not suitable for affixing to equipment. Then, there are U.S. Pat. Nos. 2,151,846, 2,418,638, 2,788,817, and 3,505,700 which reveal a "thimble" that fits adjustably over a finger. One allows for changing tools. However, none of these inventions include a shaft either fixed or configurable, nor a means of angling attached tools to suit intended use. In addition, the second patent requires the thimble be rotated around the finger by the thumb and so, the thumb cannot be fitted with a tool and used in concert with one or more fingers in working with objects. In fact, none of these patents allows for the attachment of a plurality of tools to a plurality of digits or equipment to create a tool set. U.S. Pat. No. 7,229,346 covers a finger-griping sleeve formed from a spirally wrapped spring tube but, does not address any of the other parts of the present invention.

There is little in the way of a simple means of attaching tools to and removing them from machines or robots without extensive mechanical work. For example, U.S. Pat. No. 4,627,785 describes extending fingers that are hollow allowing for attachment. However, this requires a "computer controlled locking mechanism" described in an entirely separate U.S. Pat. No. 4,591,198. Then, there is U.S. Pat. No. 4,543,032 which is representative of changeable robotic finger tools. It describes a highly complex and specialized griping and release mechanism that cannot be used on human or prosthetic digits.

U.S. Pat. Nos. 3,802,302 and 3,490,078 are representative of tool holding prosthetic devices which are designed to replace the entire hand, not to attach to a plurality of prosthetic digits on a prosthetic hand, let alone a real hand or other equipment. U.S. Inventions such as U.S. Pat. No. 2,706,296 cover entire prosthetic hands but do not provide a means for easily detaching the tip of a prosthetic digit and replacing it with a tool or attaching a tool directly to the tip of a prosthetic digit. U.S. Pat. No. 6,238,358 B1 includes a configurable set of tools that can be attached to a flexible medical device that can be placed on a hand or prosthetic hand but does not attach to individual digits.

U.S. Pat. No. 2,685,880 reveals a compass-forceps that includes a "holder" into which the user can slip the pointer finger to gain better control. The absence of this part does not render the forceps nonfunctional and requires the thumb to operate. Furthermore, it does not allow for attachment to a plurality of digits or equipment. U.S. Pat. Nos. 2,846,766, 2,889,160 and 3,834,021 suffer from similar problems and involve complex methods of attachment to the hand.

As far back as the nineteenth century inventors have been struggling with improving how we hold utensils and writing tools. For example, U.S. Patent 565,374 reveals a pen held to the hand using a palm strap and a plurality of rings that are fixed in size to receive the ring and little finger. The result is a single use tool where the means of affixing to the hand is cumbersome. U.S. Pat. No. 503,011 reveals a simpler pen or pencil holder consisting of a single adjustable finger ring attached to a holder. Again, there is no configurability or extensibility. For example, the invention prevents the user from changing the angle of the pen or pencil. More recently many configurable eating utensils have been invented such as U.S. Pat. No. 4,325,187 where a spoon is attached to a holder that straps to a hand and the spoon's orientation can be adjusted using a hinge. However, this invention does not utilize the fingers, nor does it provide configurability.

Historically, many cultures have utilized devices called chop sticks to eat. This involves using two narrow straight rods held in one hand to grasp, pick up, move, and release a wide variety of foods. Their design requires they be manipulated in concert to pinch a piece of food, lift it up, and release it into the mouth. In its present state, the chop stick provides a less than ideal grasping surface allowing round, slippery, irregular, granular, and/or friable pieces of food to drop before reaching the mouth. Furthermore, it provides a limited means of manipulating large pieces of food prior to placement in the mouth necessitating dividing food it into smaller pieces with another utensil before eating. Furthermore, chop sticks require a significant coordination of the muscles of the hand to get the narrow straight rods to work properly and this leads to frequent re-adjustment in the hand to optimize use. Prior art search produced numerous patents describing some form of hinge mechanism that couples the two rods together or provides another means to stabilized them in the hand. For example, U.S. Pat. Nos. 9,468,322 B2, 7,182,378 B25, 6,454,328 B1, 426,039, and 4,721,334 to name a few. None of these and others examined reveal a configurable tool set that can be affixed to digits and used to eat food.

Therefore, virtually all prior art lacks the capability of creating configurable tool sets that allow for an attachment to a plurality of digits or equipment providing a plurality of uses. The prior art that most closely approaches the present invention is U.S. Pat. No. 4,821,417 whereby a shaft "which is terminated by any of an assortment of removable tools and utensils." that is affixed to a hand", not digits, and requires a handle that is bent around the hand, such that, "once bent, . . . remains in its deformed position." This invention excludes attachment and removal from individual digits or equipment and precludes using a plurality of tools or utensils by affixing more than one to the same hand. Another U.S. Pat. No. 4,809,435 reveals chop sticks with removable "food engaging member". However, this invention simply converts a set of chop sticks into a fixed utensil that does not fit onto a digit or other equipment.

For the foregoing reasons and many others to be revealed herein below, there is a need for an improved tool that provides a structure and methodology to work with objects with a greater degree of configurability and extensibility when affixed to either digits or equipment providing a means to work with objects with greater capability, and functionality.

SUMMARY OF THE INVENTION

Accordingly, it is an object of this invention to provide a unique structure and methodology that solves all the above said limitations of Prior Art while adding additional capabilities. This is achieved through modularization of the working parts of the present invention to create a plurality of configurable and extensible tools that can be easily affixed to and removed from digits and equipment as revealed herein below to create tools sets.

BRIEF DESCRIPTION OF DRAWINGS—FIGURES

Various other objects, features, and attendant advantages of the present invention will be more fully appreciated as the same becomes better understood when considered in conjunction with the accompanying drawings.

DRAWINGS—REFERENCE NUMERALS AND LINES

Each part revealed herein below is identified uniquely. This identifier is linked to a part by a simple line. Closely related parts revealed in the same figure are assigned the same number but different alphabetic suffixes ranging from a through z indicating that each is a variation or modification of a part with the same or similar function. Lines ending in arrows indicate an assembly or subassembly of parts referenced in the specifications. The same parts in different views of the drawings bear the same number.

FIG. 1*a* is an exploded, perspective view of a first embodiment of the invention.

FIG. 1*b* is an exploded, perspective view of a second embodiment of the invention.

FIG. 1*c* is an exploded, perspective view of a third embodiment of the invention.

FIG. 1*d* is an exploded, perspective view of a fourth embodiment of the invention.

FIG. 1*e* is an exploded, perspective view of a still further embodiment of the invention.

FIG. 2*a* is a cross-sectional view of sleeve 106*a* of FIG. 1*a*.

FIG. 2*b* is a cross-sectional view of sleeve 106*b* of FIG. 1*b*.

FIG. 2*c* is a cross-sectional view of sleeve 106*d* of FIG. 1 *c*.

FIG. 2*d* is a cross-sectional view of sleeve 106*d* of FIG. 1*d*.

FIG. 3*a* is a front view, partially in phantom, of a further embodiment of the invention.

FIG. 3*b* is a front view, partially in phantom, of an additional embodiment of the invention.

FIG. 3*c* is a perspective view of an embodiment of the invention where the shafts 303*a* and 303*b* are at a fixed angle to one another.

FIG. 3*d* is a perspective view, partially in phantom, of a further embodiment of the invention where shafts 303*c* and 303*d* are provided with a joint 306 allowing the adjustment of the angle of the shafts 303*c*, 303*d*, relative to one another.

DETAILED DESCRIPTION OF THE PREFERRED EMBODIMENT

Multiple Embodiments of Configurable Tools and Tool Set; Exploded Views

Figure 1A:
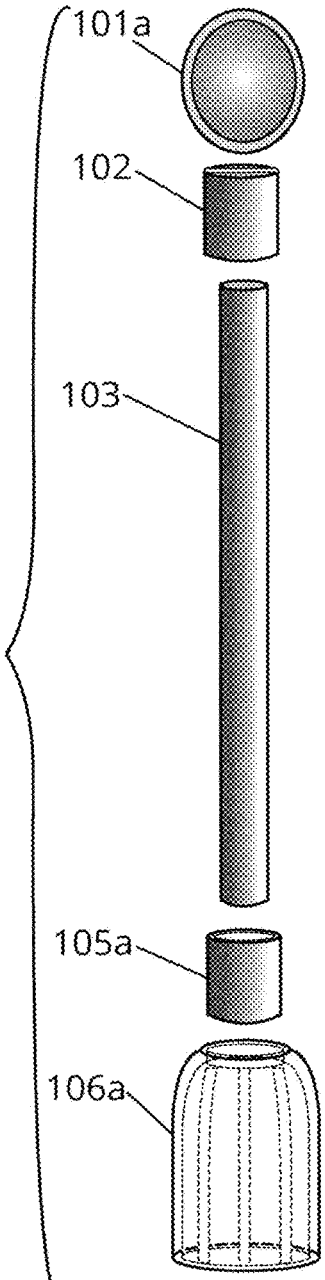
Figure 1B:
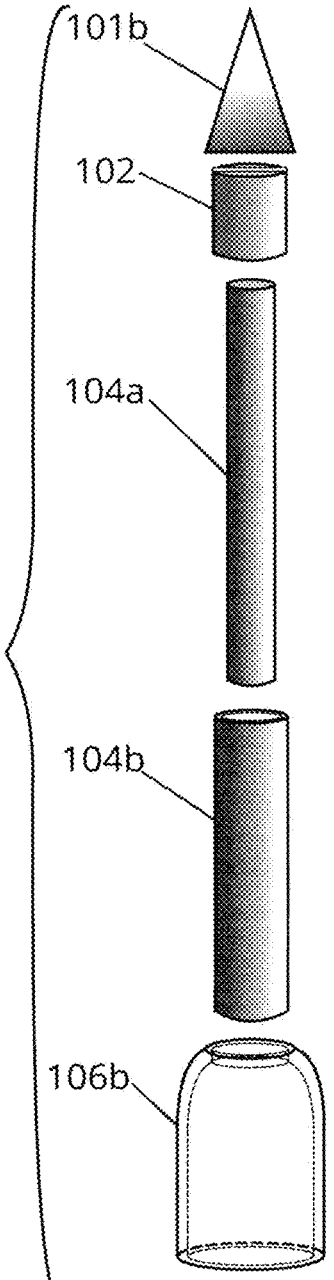
Figure 2A:
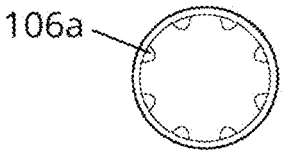
Figure 2B:
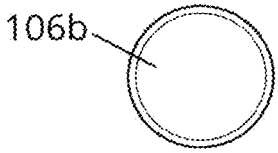
Figure 1C:
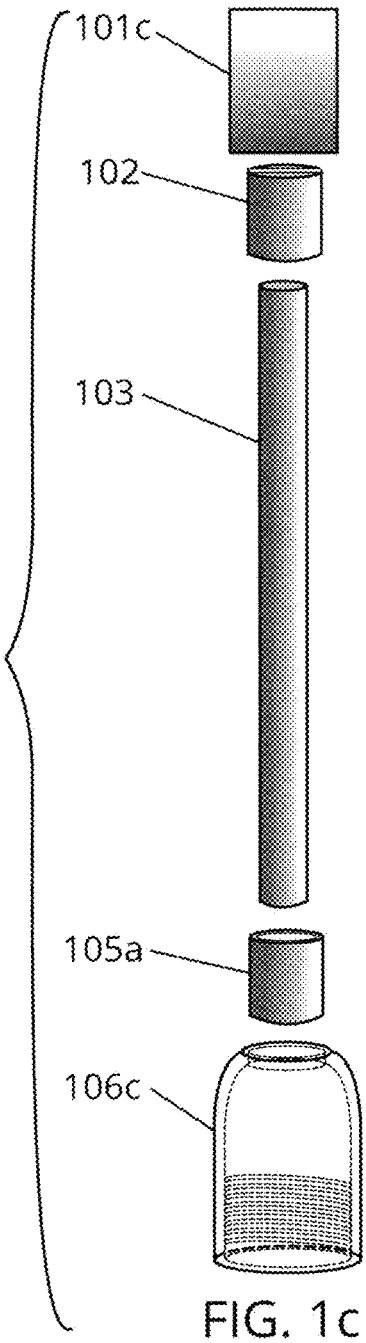
Figure 1D:
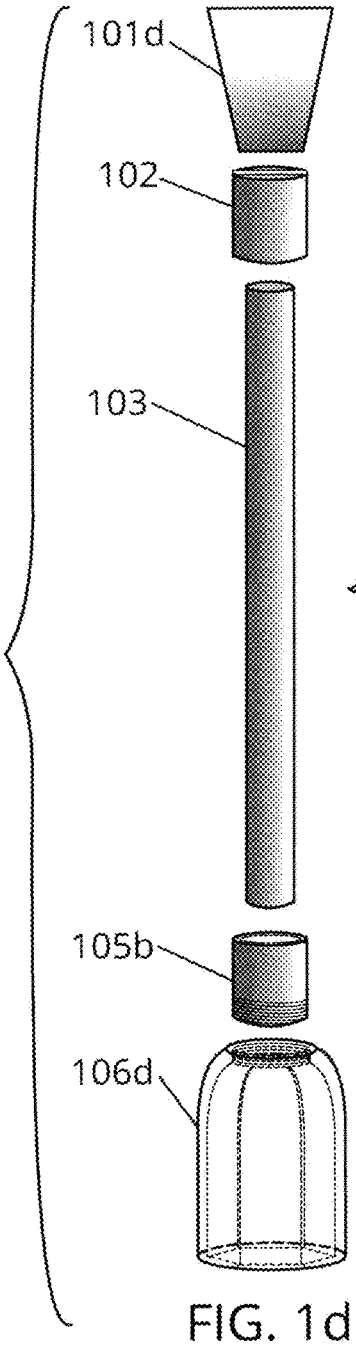
Figure 1E:
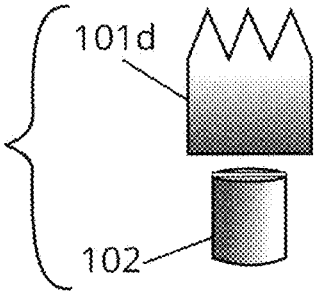
Figure 2C:
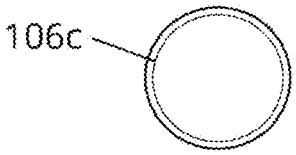
Figure 2D:
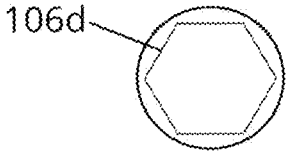
Figure 3A:
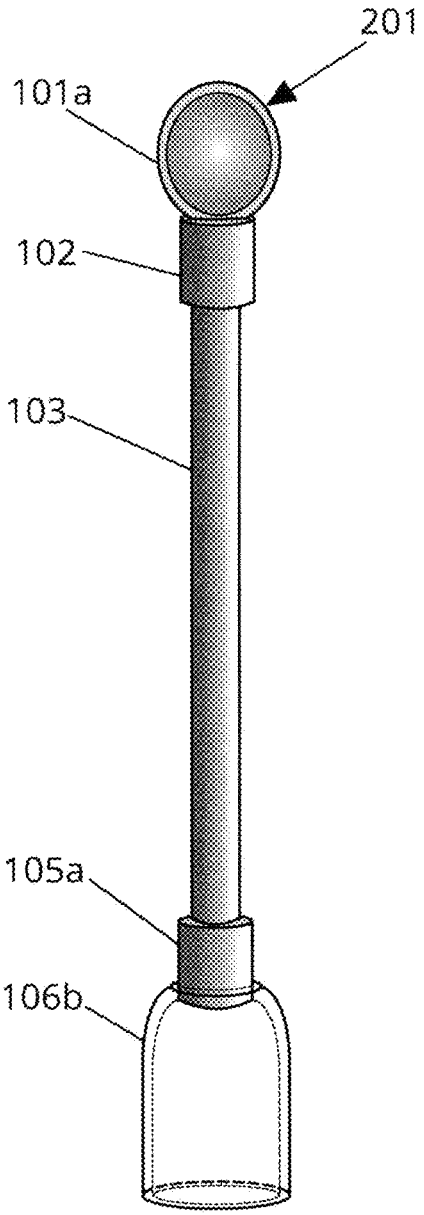
Figure 3B:
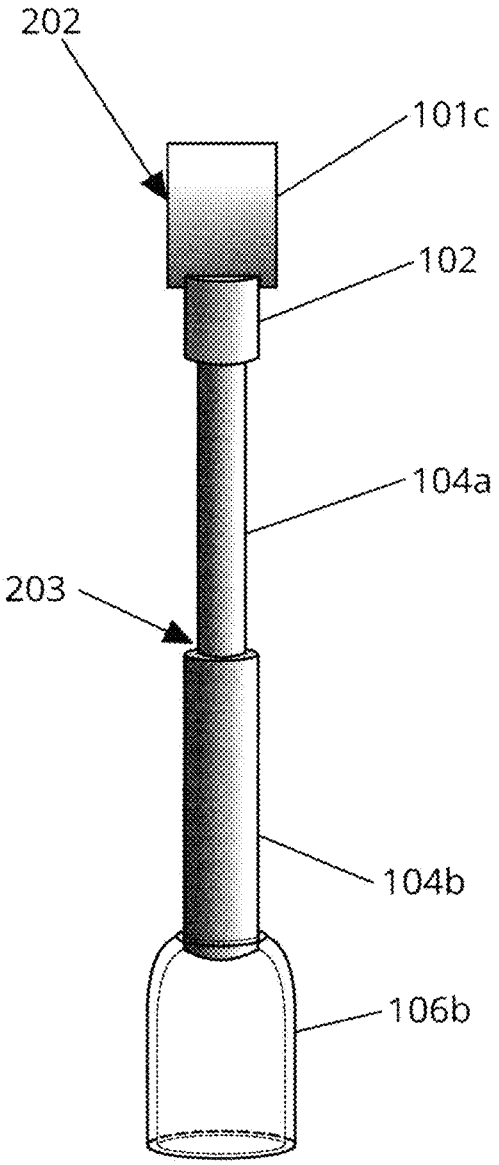
Figure 4:
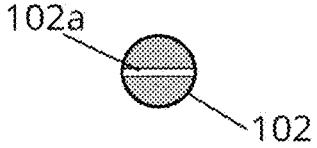
FIG. 4 is a top view of an upper connector 102 of FIG. 1*a*.
Figure 5:
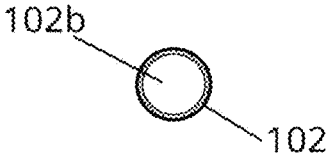
FIG. 5 is a bottom view of an upper connector 102 of FIG. 1*a*.

Shown in FIG. 1*a* is a three-dimensional exploded, perspective view of one of the embodiments of the tool of the present invention. This embodiment comprises an element (101*a*) constructed of rigid, semi-rigid, or pliable materials including, but not limited to metal, wood, plastic, rubber, fibers, and fabric. In this embodiment the element (101*a*) shown is a cup shaped element for grasping or picking up. Other elements of different shape as shown in the several embodiments of the invention can be substituted for element (101*a*) in FIG. 1*a*. Elements, such as (101*d*), shown in FIG. 1*d* is a flat wedge shape for grasping, scraping or cutting. A triangular shaped element (101*b*), shown in FIG. 1*b*, can be used for grasping or spearing. A rectangular shaped element (101*c*) as shown in FIG. 1 *c* can be used for grasping or cutting. A serrated element (101*e*), as shown in FIG. 1*e*, can be used for grasping, spearing, or cutting. A person skilled in the art will see that a plurality of additional elements may be fashioned to meet a plurality of needs, including but not limited to screw drivers, punchers, brushes, and hooks. Each said device is assembled to one of a plurality of upper connectors (102) constructed of rigid or semi-rigid materials. A slot (102*a*), as shown in FIG. 4, is manufactured into an upper end of the upper connector (102) to accept the lower end of one of a plurality of devices (101*a*, 101*b*, 101*c*,101*d*, 101*e*) and the lower end of the upper connector (102), as shown in FIG. 5 manufactured to create a cylindrical opening (102*b*) to accept one of a plurality of shafts (103, 104*a*) (FIGS. 1, 2, and 3) and (303*a*, 303*c*) (FIG. 4) constructed of rigid or semi-rigid materials. A person skilled in the art will see that the lower ends of devices (101*a*, 101*b*, 101*c*,101*d*, 101*e*) and the upper end of the upper connector (102*a*) can be designed and manufactured to allow the affixing of said devices to said upper connector (102) by a plurality of methods including but not limited to friction, threads, screws, clips, spring loaded key slots, welding, and cement allowing said devices (101*a*, 101*b*, 101*c*,101*d*, 101*e*) to be assembled temporarily or permanently. A person skilled in the art will also see that the cylindrical opening shown in the lower end (102*b*) of the upper connector (102) of FIG. 5 can be smooth, scored with vertical ridges, threaded, or otherwise manufactured to accept and temporarily affix the lower end (102*c*) of said upper connector (102) to the upper end of a plurality of one of shafts (103, 104*a*) (FIGS. 1, 2, and 3) and (303*a*, 303*c*) (FIG. 4) which, in turn, can be manufactured to be received. In this embodiment of the invention, a fixed shaft is shown as a straight cylinder (103). However, a person skilled in the art will also see that said fixed shaft can be assembled from a plurality of straight or curved rods with a plurality of cross sections such as a polygon and, furthermore, that the shaft can be manufactured of pliable material to allow for flexing and spring-like action. Furthermore, a person skilled in the art will see that a shaft can be assembled from a plurality of smaller shafts herein below referred to as shaft segments that can be fitted together by a plurality of means like those revealed hereinabove. In this case, an example is shown consisting of two shaft segments (104*a*, 104*b*) in FIG. 1*b* whereby the upper end of the lower shaft segment (104*b*) is manufactured to accept the lower end of the upper shaft segment (104*a*) such that the upper shaft segment (104*a*) can be slid up and down inside the lower shaft segment (104*b*). This relationship can be reversed so that the upper shaft segment (104*a*) slides up and down over the lower shaft segment (104*b*). When assembled, the two segments (104*a*, 104*b*) form an extensible shaft that can be adjusted to a plurality of lengths. A person skilled in the art will see that the ends of shaft segments (104*a*, 104*b*) can be smooth, scored with vertical ridges, spring loaded key slots, threaded, or otherwise manufactured allowing the upper shaft segment (104*a*) to be affixed to the lower shaft segment (104*b*) introducing the ability to adjust the total length defined by the shaft segments (104*a*,104*b*) when assembled while providing enough stability to temporarily fix said length while further allowing shaft segments (104*a*,104*b*) to be separated for additional configurability, extensibility, capability, and functionality through the attachment of a plurality of additional shorter, longer, angled, or articulated shaft segments (also see FIGS. 3*b*, 3*c* and 3*d*). The lower end of either the shaft (103) or shaft segment (104*b*) can be assembled to the upper end of one of a plurality of possible lower connectors (105*a*) (FIG. 1*a*, 1*c*), or (105*b*) (FIG. 1*d*), constructed of rigid or semi-rigid materials, that can be like or identical to the above said upper connector (102). The lower end of one of a plurality of lower connectors (105*a*,105*b*) can be assembled to the upper end of one of a plurality of possible sleeves (106*a*, 106*b*,106*c*,106*d*) constructed from a plurality of materials with shape, consistency, and surfacing that allows them to be affixed to a digit or equipment, such that it remains in place during use of the entire assembly. A person skilled in the art will see that a plurality of lower connectors (105*a*,105*b*) can be assembled to a plurality of sleeves (106*a*,106*b*,106*c*, 106*d*) by a plurality of methods including but not limited to threads, a screw, clip, spring loaded key slots, welding, and cement so that it they can be either removable or permanently assembled. Furthermore, as shown, the sleeves (106*a*, 106*b*, 106*c*, 106*d*) can be manufactured to be affixed to round, polygonal, or irregular surfaces using ridges, matching polygonal shape, screws, threads, spring loaded key slots or friction. The entire assembly above described is hereinbelow referred to as a tool. A person skilled in the art will see that the upper connector (102) and lower connectors (105*a*, 105*b*) can be dispensed with by incorporating their capabilities into the upper ends of said shafts (103, 104*a*, 303*a*, 303*c*) and lower ends of said shafts (103, 104*b*, 303*b*, 303*d*) as shown in FIGS. 1*b* and 3*b*. Said assembled plurality of tools can be used to work with a plurality of objects and provides the means of assembling and disassembling a plurality of shafts, connectors, and sleeves to accommodate a plurality of digits and equipment. When at least two of the above said tools are affixed to at least two digits or pieces of equipment, a tool set is created. Furthermore, the number of tools that can be assembled into a tool set is limited only by the number of digits and/or pieces of equipment that can work in concert with each other.

One First and Second Embodiment of a Configurable Tool Set; Assembled View: FIGS. 3*a* and 3*b*

Shown in FIGS. 3*a* and 3*b* are front views, partially in phantom of two fully assembled nonexclusive embodiments of the present invention. The first tool (201) consists of a cup-shaped device (101*b*) assembled to one of a plurality of an upper connectors (102) assembled to one of a plurality of shafts (103) assembled to one of a plurality of lower connectors (105*a*) assembled to one of a plurality of sleeves (106*b*). The second tool (202) consists of a flat rectangular device (101*c*) assembled to one of a plurality of shaft segments (104*a*,104*b*) assembled into an adjustable length shaft (203) further assembled to one of a plurality of sleeves (106*b*).

One Third and One Fourth Embodiment of a Configurable Tool Set; Assembled View FIGS. 3*c* and 3*d*

Figure 3C:
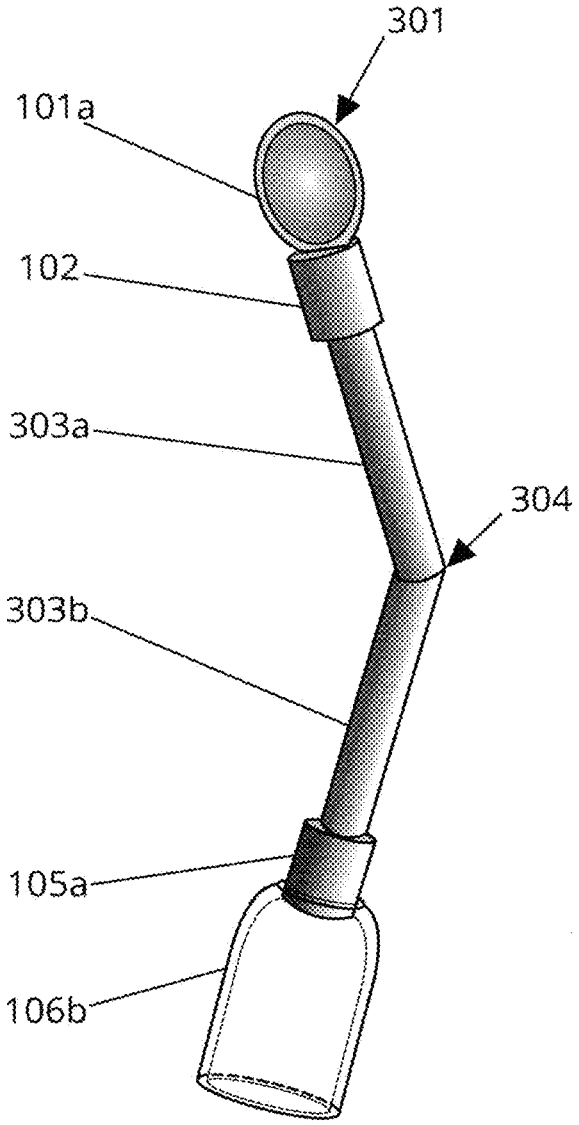
Figure 3D:
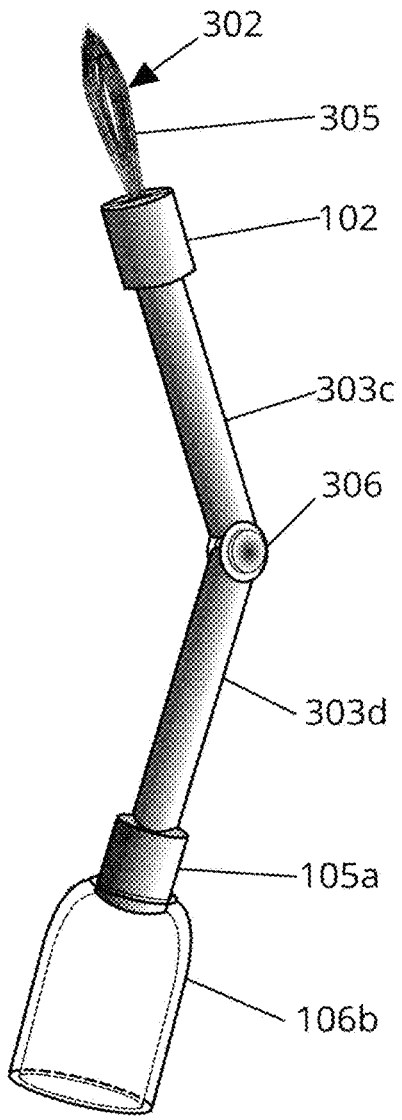

Shown in FIGS. 3*c* and 3*d* are perspective views of two additional embodiments of the present invention fully assembled. The tool (301) consists of a cup-shaped device (101*a*) assembled to one of a plurality of upper connectors (102) assembled to one of a plurality of first shaft segments (303*a*) assembled to one of a plurality of second shaft segments (303*b*) to form one of a plurality of fixed angle tools (304) further assembled to one of a plurality of lower connectors (105*a*) assembled to one of a plurality of sleeves (106*b*). A person skilled in the art will see that a plurality of fixed angle tools (304) can be achieved varying from near zero degrees (0°) to near one hundred-eighty degrees (180°) using a plurality of above said methods. The tool (302) consists of a flexible brush device (305) assembled to one of a plurality of upper connectors (102) assembled to one of a plurality of first shaft segments (303*c*) assembled to one of a plurality of adjustable joints (306) assembled to one of a plurality of second shaft segments (303*d*) that allows the formation of an adjustable angle between the above said two shaft segments (303*c*,303*d*) assembled to one of a plurality of lower connectors (105*a*) assembled to one of a plurality of sleeves (106*c*). A person skilled in the art will see that the joint (306) can be either a simple hinge that allows rotation in one plane or a ball joint that allows rotation in a plurality of planes. A person skilled in the art will also see that the affixing of a plurality of nonexclusive shaft segment types revealed herein above (104*a*,104*b*,303*a*,303*b*, 303*c*,303*d*) with a plurality of joints (306) would allow the assembly of a shaft with fixed or adjustable length with either fixed or adjustable angle and even a combination of all of the above capabilities greatly increasing configurability, extensibility, capability, and functionality; and, therefore, usefulness of the subsequent tool set in working with objects.

Figure 6:
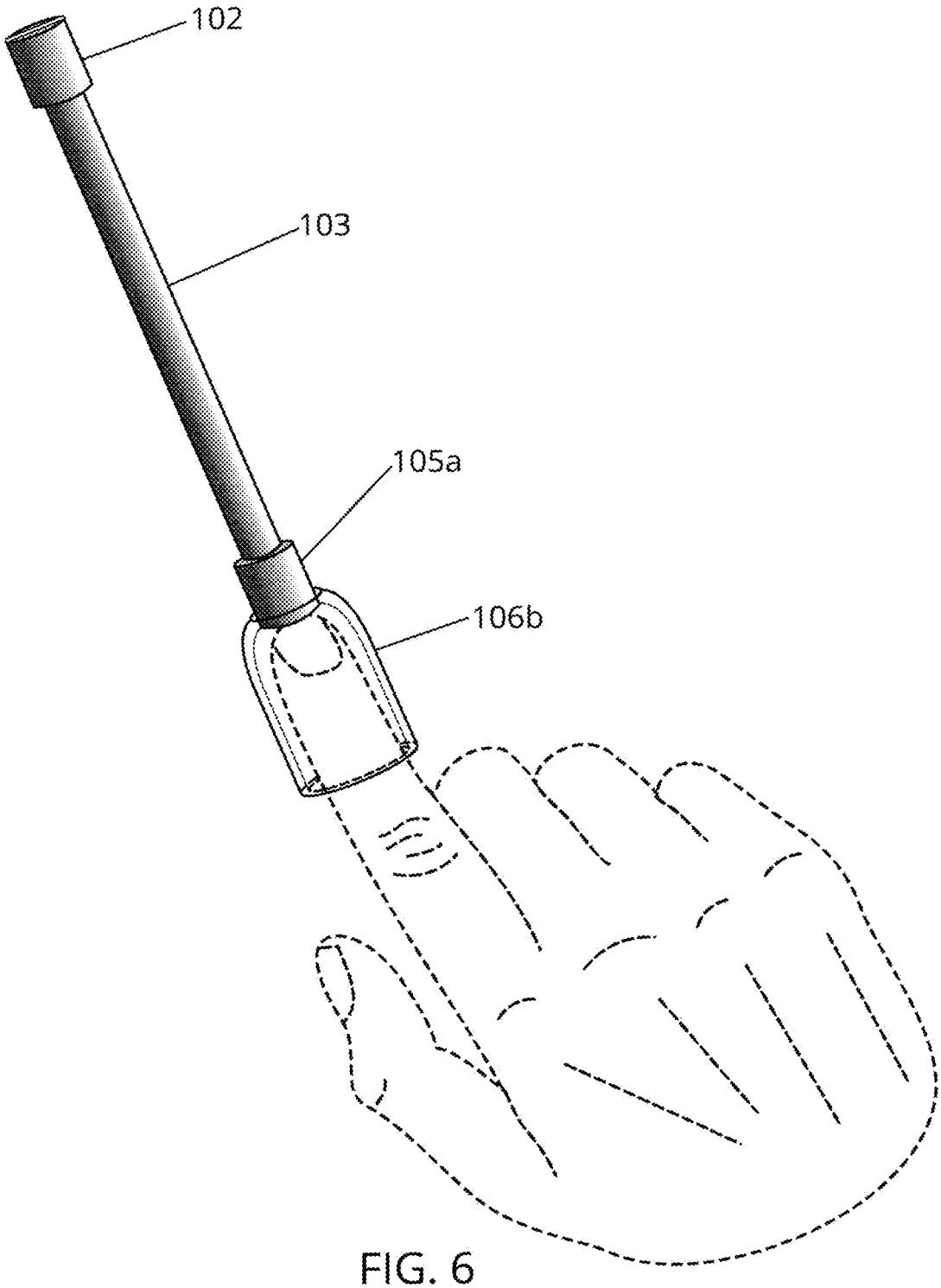
FIG. 6 is a perspective view, partially in phantom, of one embodiment of the present invention, illustrating an environment of use of the invention on a digit (finger) of human hand (in phantom).

As shown in FIG. 6, a sleeve (106*b*) can be affixed to a digit, such as a finger of a human hand. The sleeve (106*b*) is connected to the lower connector (105*a*) which is connected to shaft (103) which is connected to upper connector (102), which can be connected to any of elements (101*a*, 101*b*, 101*c*, 101*d*, 101*e*, or 305) at the upper end 102*a*. A person skilled in the art will also see this embodiment is not limited to these elements or their equivalents, as described herein. Of course, more tools could be attached to any of a plurality of digits, other than the illustrated index finger of a human hand.

SUMMARY, RAMIFICATIONS, AND SCOPE

In summary, the various embodiments of the present invention revealed herein above provide a new and unique structure and methodology of manufacturing and assembling tool sets that can be fitted to a plurality of digits and equipment that allows for working with a wide variety of objects including but not limited to food.

Furthermore, the various embodiments of the present invention provide the additional unique benefit of being capable of assembly to a plurality of other devices not shown herein above to form a plurality of additional tools and tool sets including, but not limited to drills, grinders, flash lights, aerosol projectors, writing tools, and laser pointers.

Furthermore, the various embodiments of the present invention provide the additional unique benefit of being capable of assembly to a plurality of other tools to create a plurality of enhanced tools that can be assembled to robotic systems to increase configurability, extensibility, capability, and functionality.

Furthermore, the various embodiments of the present invention provide the additional unique benefit of being capable assembly to a plurality of prostheses to increase configurability, extensibility, capability, and functionality in persons with lost digits, hands, and even feet who have fixed prostheses.

OTHER EMBODIMENTS OF THE INVENTION

The above revealed embodiments and implementations are not meant to limit the scope of the present invention. A person skilled in the art will see that many other unspecified capabilities may be added to the tool set. A first nonexclusive example would be a tool set for rapidly sorting objects too small to be easily handled by the digits or seen without lighting or magnification such as small gemstones, seeds, screws, and electronic or computer components. The assembly of a magnifying device with a light to one of the tools in a tool set solves this problem.

What is claimed is:

1. A tool kit comprising:

a plurality of sleeves, the proximal end of each of said sleeves sized and shaped with an interior void to fit snuggly upon at least one first digit on at least one first hand of a user;

a plurality of lower connectors, a proximal surface of one of the lower connectors being operationally coupled to a distal end of one of said sleeves;

a plurality of shaft segments, each comprising a proximal end and a distal end, wherein the plurality of shaft segments allow for an operating shaft selected from the group consisting of: a single shaft segment, a plurality of shaft segments adjustably coupled together for adjustment of a total length of said plurality of shaft segments along a single axis during use of the tool kit, two shaft segments coupled together to form a fixed angle from close to 0 up to 180 degrees and two shaft segments coupled together with a joint allowing for adjustment of an angle of the two shaft segments from close to 0 up to 180 degrees relative to each other during use of the tool kit, wherein the proximal end of said operating shaft is operationally coupled to a distal surface of said one of the lower connectors;

a plurality of upper connectors, each comprising a proximal surface and a distal surface, the proximal surface one of said upper connectors being operationally coupled to the distal end of said operating shaft;

a plurality of tools, a proximal end of one of the tools being operationally coupled to the distal surface of said one of the upper connectors;

wherein said tool kit allows for combination of above said lower connectors, shaft segments, upper connectors and first tools to define a plurality of tool sets attachable to a plurality of digits.

2. The tool kit of claim 1, wherein said one of the lower connectors and said one of said sleeves are operationally coupled by at least one of threads, a screw, a clip, and a spring loaded key slot.

3. The tool kit of claim 1, wherein the digit is a finger of a human hand.

4. The tool kit of claim 1, wherein the digit is a finger on a prosthetic hand.

5. The tool kit of claim 1, wherein said operating shaft comprises at least two shaft segments.

6. The tool kit of claim 1, wherein at least one of the shaft segments comprises a flexible material.

7. The tool kit of claim 1, wherein said one of the plurality of the upper connectors comprises a slot into which a lower end of said one of the tools is connected.

8. The tool kit of claim 1, wherein said one of the upper connectors and said one of the tools are operationally coupled by at least one of friction, threads, screws, clips, and spring loaded key slots.

9. The tool kit of claim 1, wherein said one of the tools comprises at least one from the group consisting of metal, wood, plastic, rubber, fibers and fabric.

10. The tool kit of claim 1, wherein said one of the tools is capable of at least one selected from the group consisting of grasping, scraping, cutting, spearing, punching, brushing, hooking, screw driving, and picking up.

11. The tool kit of claim 1, wherein said one of the tools has a shape selected from the group consisting of flat wedged-shaped, cup-shaped, triangular-shaped, rectangular-shaped, serrated-shaped, brush-shaped, punch-shaped, screw-driver-shaped and hook-shaped.

12. The tool kit of claim 1, wherein the interior void comprises at least one selected from the group consisting of a polygon-shape, a ribbed-shape, a threaded-shape and a smooth-shape.

13. The tool kit of claim 1, wherein said one of the upper connectors comprises a lower surface comprising a void into which the operating shaft fits and further comprises an upper surface comprising an upper void to engage said one of the tools.

14. The tool kit of claim 1, wherein at least one of the shaft segments end comprises at least one element selected from the group consisting of a smooth surface, a surface scored with vertical ridges, a spring loaded key slot, and threads, whereby allowing said at least one shaft segments end to be coupled to another shaft segment defining said operating shaft.

15. The tool kit of claim 1, wherein the joint comprises one selected from the group consisting of a hinge and a ball joint.

* * * * *